US011198976B2

(12) United States Patent
Leys et al.

(10) Patent No.: US 11,198,976 B2
(45) Date of Patent: Dec. 14, 2021

(54) MODULAR FLOOR FOR PROVIDING SUPPORT TO VEHICLES AND CROWDS ON AN UNEVEN OR SOFT SUBSURFACE, AND PLANK, INSTALLATION METHOD, AND PRODUCTION METHOD THEREFOR

(71) Applicant: Roadrunner Concert Service NV, Hoboken (BE)

(72) Inventors: Philippe Leys, Hoboken (BE); Jeroen Van Beek, Hoboken (BE)

(73) Assignee: Roadrunner Concert Service NV, Hoboken (BE)

( * ) Notice: Subject to any disclaimer, the term of this patent is extended or adjusted under 35 U.S.C. 154(b) by 95 days.

(21) Appl. No.: 16/611,560

(22) PCT Filed: May 8, 2018

(86) PCT No.: PCT/EP2018/061909
§ 371 (c)(1),
(2) Date: Nov. 7, 2019

(87) PCT Pub. No.: WO2018/206597
PCT Pub. Date: Nov. 15, 2018

(65) Prior Publication Data

US 2021/0148060 A1 May 20, 2021

(30) Foreign Application Priority Data

May 8, 2017 (EP) ..... 17170002

(51) Int. Cl.
*E01C 9/08* (2006.01)
*E04F 15/02* (2006.01)
*E04C 2/36* (2006.01)

(52) U.S. Cl.
CPC ..... *E01C 9/083* (2013.01); *E04C 2/36* (2013.01); *E04F 15/02038* (2013.01);
(Continued)

(58) Field of Classification Search
CPC . E01C 9/083; E01C 9/086; E01C 9/08; E01C 2201/16; E01C 2201/12;
(Continued)

(56) References Cited

U.S. PATENT DOCUMENTS 3,301,147 A 1/1967 Clayton
3,348,459 A * 10/1967 Harvey ..... E01C 9/083 404/35

(Continued)

FOREIGN PATENT DOCUMENTS

EP 1950349 A2 7/2008

*Primary Examiner* — Brent W Herring
(74) *Attorney, Agent, or Firm* — James Creighton Wray

(57) ABSTRACT

A modular floor for providing support to a vehicle and/or a crowd on an uneven or soft subsurface of a supporting terrain is disclosed. The modular floor comprises at least two planks, each plank comprising a top and a bottom plate separated by a plurality of spacing plates. A first plank comprises a male connection element and a second plank a female connection element to interconnect the first and second planks. The connection elements are configured to extend a modular floor of interlocked planks both at an edge comprising a male connection element as well as at an edge comprising a female connection element. Preferably, a plank is a single-piece component, comprising aluminum alloy or plastic.

16 Claims, 10 Drawing Sheets

(52) U.S. Cl.
CPC ..... *E01C 2201/16* (2013.01); *E04F 15/02183* (2013.01); *E04F 2201/023* (2013.01); *E04F 2203/04* (2013.01)

(58) Field of Classification Search
CPC ..... E04F 15/02038; E04F 2203/04; E04F 15/02183; E04F 2201/025; E04F 2201/023; E04F 2201/03; E04C 2002/3488; E04C 2/36
USPC ..... 52/589.1, 581, 578, 588.1; 404/35, 40, 404/41
See application file for complete search history.

(56) References Cited

U.S. PATENT DOCUMENTS 3,377,931 A * 4/1968 Hilton ..... E01C 9/083 404/35
3,385,182 A * 5/1968 Harvey ..... F16B 5/008 404/35
3,385,183 A * 5/1968 Kortz ..... E01C 9/083 404/35
3,450,010 A * 6/1969 Harvey ..... E01C 9/083 404/35
3,557,670 A 1/1971 Sutton
3,572,224 A * 3/1971 Perry ..... E01C 9/083 404/40
RE27,147 E * 6/1971 Harvey ..... E01C 9/083 404/35
3,614,915 A 10/1971 Perry
3,784,312 A * 1/1974 Gordon ..... E02D 27/04 404/35
6,685,391 B1 * 2/2004 Gideon ..... E01D 19/02 405/16
6,718,588 B1 * 4/2004 Frederiksen ..... B65G 69/30 14/69.5
7,090,430 B1 * 8/2006 Fletcher ..... E01C 9/086 404/35
7,364,383 B2 * 4/2008 Fletcher ..... E01C 9/086 404/35
7,370,452 B2 * 5/2008 Rogers ..... E01C 9/086 52/177
8,336,146 B1 * 12/2012 Berbash ..... E01C 11/26 14/69.5
10,519,654 B2 * 12/2019 Darwell ..... E04C 2/38
10,907,348 B2 * 2/2021 Darwell ..... E04B 2/8652
2002/0144364 A1 * 10/2002 Anderson ..... E04F 11/002 14/69.5

* cited by examiner

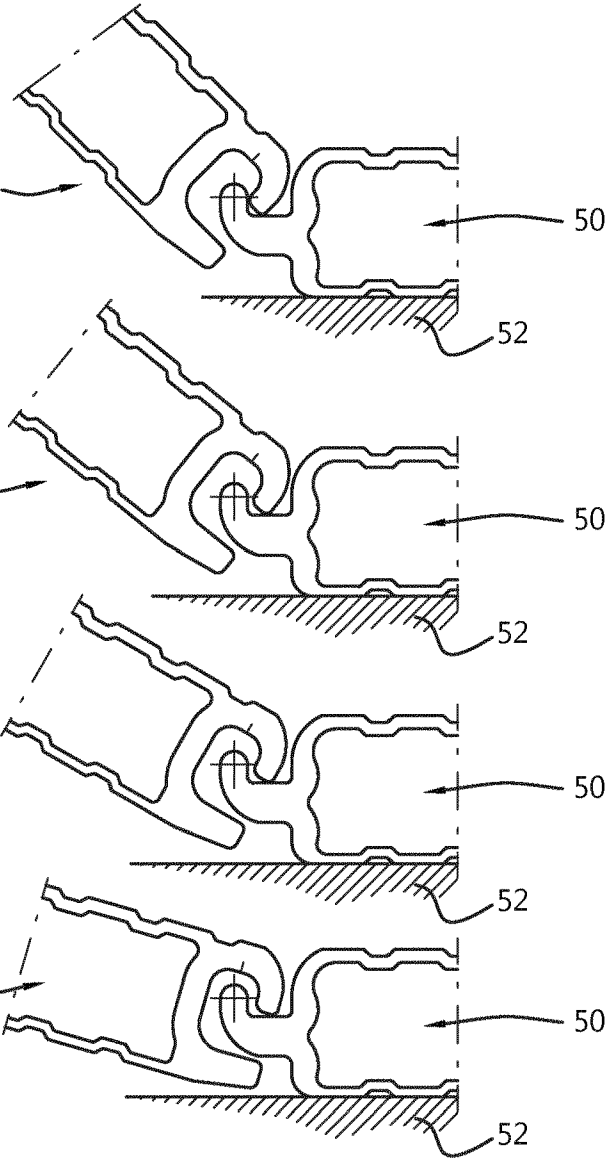
Fig. 5A
Fig. 5B
Fig. 5C
Fig. 5D
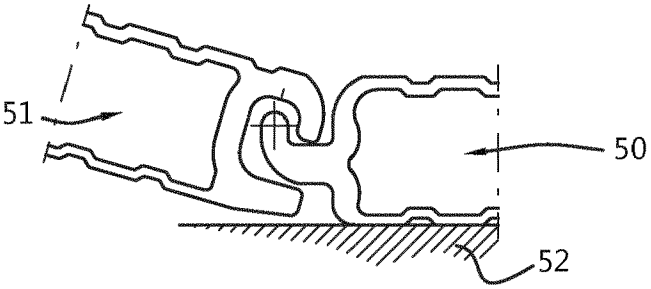
Fig. 5E
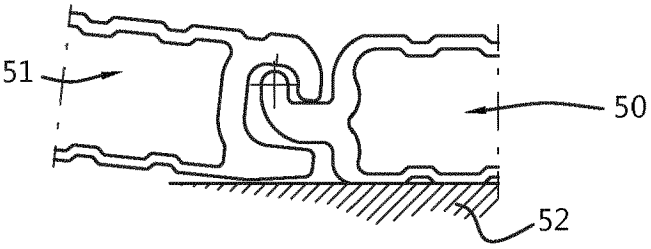
Fig. 5F
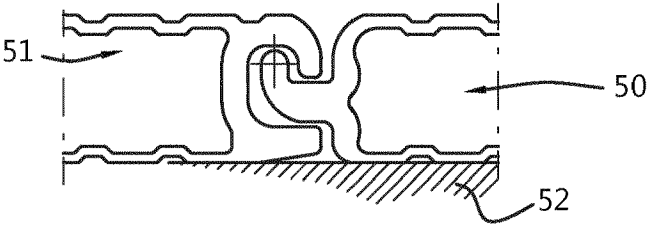
Fig. 5G

MODULAR FLOOR FOR PROVIDING SUPPORT TO VEHICLES AND CROWDS ON AN UNEVEN OR SOFT SUBSURFACE, AND PLANK, INSTALLATION METHOD, AND PRODUCTION METHOD THEREFOR

This application claims the benefit of European Application No. 17170002.4 filed May 8, 2017 and PCT/EP2018/061909 filed May 8, 2018, International Publication No. WO 2018/206597 A2, which are hereby incorporated by reference in their entirety as if fully set forth herein.

TECHNICAL FIELD

A modular floor for providing support to a vehicle and/or a crowd on an even, uneven or soft subsurface of a supporting terrain is disclosed. The modular floor comprises at least two planks, each plank comprising a top and a bottom plate separated by a plurality of spacing plates. A first plank comprises a male connection element and a second plank a female connection element to interconnect the first and second planks. The connection elements are configured to extend a modular floor of interlocked planks both at an edge comprising a male connection element as well as at an edge comprising a female connection element. Preferably, a plank is a single-piece component, comprising aluminum alloy or plastic.

BACKGROUND

U.S. Pat. No. 3,301,147 discloses vehicle-supporting matting and a plank therefor. The plank is an extruded element formed of a single body of material, preferably 6061 aluminum alloy that is heat-treated to the T-6 condition. The plank comprises a lower supporting plate and a flat topped upper deck plate joined by webs disposed at right angles to the two plates. The webs are disposed parallel with each other so as to extend coextensively with the extrusion. Thus, the cross-section of the plank is composed of a plurality of like box sections, adjacent box sections having a web in common. The lower support plate and webs are of a uniform and minimum thickness of 0.140 inch with filleted corners of joinder. The deck plate must remain flat topped and is strengthened intermediate the webs in order to ensure flatness and is therefore provided with a deepened cross-section where increased bending stresses occur.

The plank of U.S. Pat. No. 3,301,147 furthermore comprises a male and a female edge. The male edge comprises a modified marginal web comprising an upwardly opening channel at the deck plate and a downwardly faced shoulder recessed upwardly from the lower supporting plate. The channel has a bottom in a plane spaced below the deck plate, it has an inner wall joined to the deck plate at a rounded corner, and it has an outer wall parallel to the inner wall and terminating in a plane below the plate. The shoulder is a flat recess that is formed by an inwardly offset marginal section of the lower supporting plate and it joins integrally with the marginal web. The male edge of the plank presents a male element configuration in cross section. At the opposite female edge of the plank the lower supporting plate and flat topped upper deck plate are extended to form parts to mate with the male edge. The upper deck plate extension has a turned down flange, with rounded corners, that is adapted to depend into the channel for hooked engagement of adjacent planks. The male and female edges are further configured to have locked engagement of the extension of the lower support plate of the female edge in the recess and against the shoulder of the male edge. The planks are made to fit loosely and permit movement, such that it will conform to the contours of the supporting terrain, whether concaved or convexed.

From FIG. 2 of U.S. Pat. No. 3,301,147, it appears that the extruded planks can be interlocked in a staggered arrangement.

However, U.S. Pat. No. 3,301,147 is directed specifically towards landing installations for aircrafts, and requires a flat topped deck plate, devoid of openings and/or protuberances. The planks are therefore not provided with means to prevent slipping of vehicles and/or personnel on the flat topped deck plate. This is especially dangerous when the deck plate become wet due to, for example, rain. The planks are furthermore not provided with means to prevent movement of a plank with respect to a supporting surface.

In addition, the extension of the lower supporting plate at the female edge protrudes further from the female edge web than the downturned flange of the female edge. This limits the placement of the planks, as clearly indicated by the edge numbering (10, 11) in FIG. 2 of U.S. Pat. No. 3,301,147, to the placement of a male edge in the female edge of an already positioned plank. A partially laid out landing installation can therefore only be extended at the side comprising the female edges of the planks. In addition, while the extension of the lower supporting plate at the female edge comprises a small bevel at its lower surface, the bevel does not extend sufficiently as to allow for placement of a female edge around a male edge of an already positioned plank.

U.S. Pat. No. 3,301,147 furthermore does not provide means to prevent bending of the protruding elements at the male and female edges due to, for example, large impacts.

U.S. Pat. No. 3,301,147 also does not provide means for moving vehicles or aircrafts on and/or off the landing installation.

U.S. Pat. No. 3,614,915 discloses a load supporting and load transferring panel system for use in landing mat installations.

The present invention aims to resolve at least some of the problems mentioned above.

SUMMARY OF THE INVENTION

In a first aspect, the present invention concerns a modular floor for providing support to a vehicle and/or a crowd on an uneven or soft subsurface of a supporting terrain, as described in claim 1.

In a second aspect, the present invention concerns a plank for providing support to a vehicle and/or a crowd on an uneven or soft subsurface of a supporting terrain, as described in claim 11.

In a third aspect, the present invention concerns a method for installing a modular floor for providing support to a vehicle and/or a crowd on an even, uneven or soft subsurface of a supporting terrain, as described in claim 12. The method is particularly advantageous for installing a modular floor for providing support to a vehicle and/or a crowd on an uneven or soft subsurface of a supporting terrain.

In a fourth aspect, the present invention concerns a method for manufacturing a plank according to the second aspect, as described in claim 14.

In a fifth aspect, the present invention concerns an end floor piece according to claim 15, and a method for manufacturing such end floor piece according to claim 16, as well as a modular floor comprising at least one such end floor piece.

The present invention is advantageous for a plurality of reasons. The slanted outer surface portion of the lower recess wall of the female connection element of a plank is configured for placing the recess of the female connection element over the hook of a male connection element of another plank which is already positioned on a subsurface, without being hindered by the subsurface. Alternatively, the hook of the male connection element of a plank can also be engaged in the recess of the female connection element of an already positioned plank, without being hindered by said subsurface. A road mat comprising interconnected planks and comprising an edge comprising a male connection element and an edge comprising a female connection element, can then be extended at both edges, which allows for a quicker and more flexible way to extend the road mat.

DESCRIPTION OF FIGURES

FIGS. 5*a* to 5*g* show a schematic representation of a cross section of the engagement of the recess of the female connection element of a first plank over the hook of the male connection element of a second plank according to a preferred embodiment of the present invention, whereby the second plank is positioned on a subsurface.

DETAILED DESCRIPTION OF THE INVENTION

Figure 1:
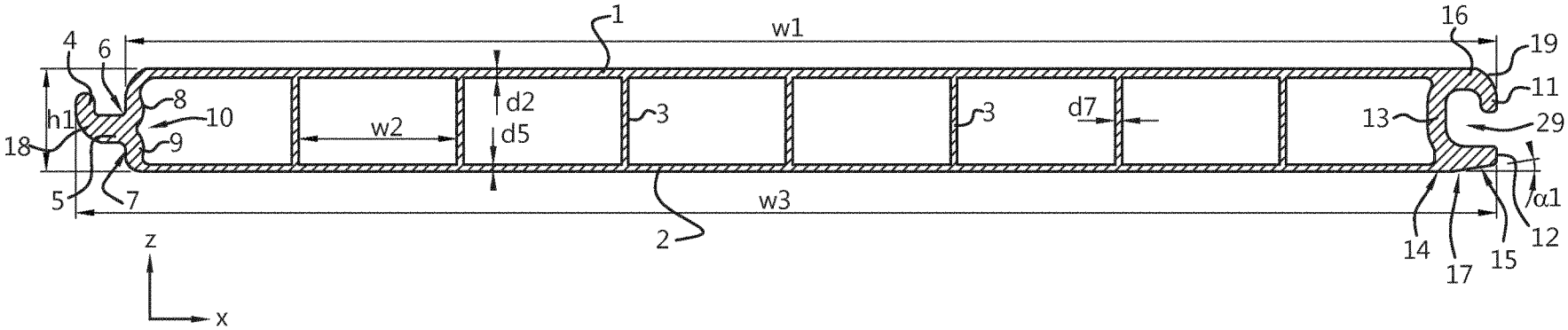
FIG. 1 shows a schematic representation of a cross section of a plank according to an embodiment of the present invention.

The present invention concerns in a first aspect a modular floor for providing support to a vehicle and/or a crowd on an uneven or soft subsurface of a supporting terrain. In a second aspect, the present invention concerns a plank for the modular floor. In a third aspect, the present invention provides a method for installing the modular floor. In a fourth aspect, the present invention pertains to a method for manufacturing a plank of the modular floor. A summary of the invention was given in the corresponding section. In what follows, a detailed description of the invention is provided, preferred embodiments are discussed, and the invention is illustrated by means of an example.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The recitation of numerical ranges by endpoints includes all numbers and fractions subsumed within that range, as well as the recited endpoints.

The expression "% by weight", "weight percent", "% wt" or "wt %", here and throughout the description unless otherwise defined, refers to the relative weight of the respective component based on the overall weight of the formulation.

"Vehicle" as used herein comprises any motorized or unmotorized rollable device. A non-limiting list of vehicles comprises a car, an SUV, a truck, a crane, a forklift, a bus, a van, a tractor, an ambulance, a firetruck, a motorcycle, a bicycle, a wheelbarrow, and the like. A rollable device can comprise any means for rolling. A crane, for example, can be provided with wheels and/or caterpillar tracks. In addition to vehicles and/or crowds, the modular floor can also be used for supporting other equipment. It may, for example, be used as a landing platform for helicopters.

A non-limiting list of "uneven or soft subsurfaces" comprises a meadow, a construction site, a beach, a dune, a desert, a dust road, a slope, and the like. Heavy equipment and/or people can at least partially sink in soft subsurfaces, especially after rainfall or heavy prior use. It may in addition be difficult to obtain grip on soft and/or uneven surfaces such as wet meadows, dunes, and the like. The present invention provides a covering means to provide support and to provide grip.

One of ordinary skill in the art will appreciate that the four aspects of the present invention relate to one invention only. The modular floor of the first aspect can comprise a plurality of planks according to the second aspect, which can be interlocked according to the third aspect and manufactured according to the fourth aspect. Preferably, the modular floor comprises at least two, and more preferably a plurality of, in essence identical planks according to the second aspect.

The planks are preferably manufactured by extrusion. Therefore they comprise a length or extrusion direction and an in essence uniform cross section perpendicular to the length direction. To manufacture a plank, an extrusion die and extrusion material are provided. The extrusion material is pushed through the extrusion die for manufacturing the plank. The extrusion material is preferably one of a metal alloy and a plastic. A non-limiting list of metals comprises aluminum, brass, copper, lead, magnesium, nickel, steel, plain carbon steel, alloy steel, stainless steel, tin, titanium, and zinc. A non-limiting list of plastics comprises acetal, acrylic, acrylonitrile butadiene styrene, nylon, polycarbonate, polyethylene, polypropylene, polystyrene, and polyvinyl chloride. Preferably, the extrusion material is one of an aluminum alloy and a plastic, to provide an optimal tradeoff between weight and strength. Aluminum or an aluminum alloy can be hot or cold extruded. If it is hot extruded, it is typically heated to 300 to 600° C. Extrusion is advantageous because (1) it is able to manufacture extrudates comprising very complex cross sections; (2) the extrusion material only encounters compressive and shear stresses; (3) it forms parts with an excellent surface finish; and (4) in metals such as, for example, aluminum or aluminum alloy, the extrusion process may also increase the strength of the material. Due to the extrusion process, each plank is a single-piece component. Alternatively to extrusion, a plank may also be manufactured by molding a metal or a plastic, for example, by injection molding. For metals, injection molding is also called die-casting.

A cross section of an embodiment of a plank is shown in FIG. 1. In addition to the length or extrusion direction, the plank comprises a width direction (x) and a height direction (z). The length, width, and height direction are mutually orthogonal. The plank comprises a top side and a bottom side spaced in the height direction (z). The plank further comprises a top plate (1) near the top side and a bottom plate (2) near the bottom side. The top and bottom plates (1, 2) extend in the width direction (x) and are mutually separated by a plurality of spacing plates (3) in essence parallel to the height direction (z). The plank further comprises a male connection element (4, 5, 8, 9, 18) and a female connection element (11, 12, 13, 16, 19) separated in the width direction (x) by the top and bottom plates (1, 2) and connected to the top and bottom plates (1, 2). The male and female connection elements are hereby connected to opposite edges of the top and bottom plates (1, 2), whereby the opposite edges are spaced in the width direction (x). The male connection element comprises a hook connection wall (8, 9) extending from the bottom plate (2) to the top plate (1) and a hook comprising a first hook portion (5) extending outwardly at least substantially in the width direction (x) from the hook connection wall (8, 9) to a corner hook portion (18) and a second hook portion (4) extending at least substantially in the height direction (z) from the corner hook portion (18) and towards the top side. The female connection element comprises a recess (29) formed by a lower recess wall (12) extending outwardly at least substantially in the width direction (x) from the bottom plate (2) to a lower recess wall end, a hind recess wall (13) extending from the bottom plate (2) to the top plate (1), and an upper recess wall comprising a first recess portion (16) extending outwardly at least substantially in the width direction (x) from the top plate (1) to a corner recess portion (19) and a second recess portion (11) extending at least substantially in the height direction (z) from the corner recess portion (19) and towards the lower recess wall (12). The recess (29) of the female connection element and the hook (4, 5, 18) of the male connection element are configured for loosely interlocking adjacent planks, allowing a modular floor built up of interlocked adjacent planks to conform to the contours of the supporting terrain, whether concaved or convexed.

In alternative embodiments, the modular floor may comprise a plank comprising two female connection elements spaced in the width direction of the plank and/or a plank comprising two male connection elements spaced in the width direction of the plank. In another embodiment, the modular floor may consist solely of planks comprising two female or two male connection elements. In the latter case, male-type planks have to be alternated with female-type planks. This however requires a proper alternating stacking of the planks to properly lay out the modular floor.

In a preferred embodiment, the lower recess wall (12) comprises an outer surface (14, 15) comprising a slanted portion (15) extending from a deflection line (17) towards said lower recess wall end and at least partially in the height direction (z) towards said top side. Hereby, the slanted outer surface portion (15) comprises a slant size in the width direction equal to at least 50% of the female connection element size in the width direction, for enabling engagement of the recess (29) over the hook of the male connection element of another plank positioned on a subsurface. The slant size in the width direction is equal to at least 50% of the female connection element size in the width direction, such as 50%, 51%, 52%, 53%, 54%, 55%, 56%, 57%, 58%, 59%, 60%, 61%, 62%, 63%, 64%, 65%, 67.5%, 70%, 72.5%, 75%, 77.5%, 80%, 85%, 90%, 95%, or any percentage above or in between, of the female connection element size in the width direction. Preferably, the slant size in the width direction is equal to at least 62.5% of said female connection element size in the width direction.

This is advantageous as it allows to interlock a new plank to a modular floor comprising interlocked planks with any one of its male and female connection elements, as discussed in the summary of the invention and below. FIGS. 5*a* to 5*g* show a schematic representation of a cross section of the engagement of the recess of the female connection element of a first plank (51) over the hook of the male connection element of a second plank (50), whereby the second plank (50) is positioned on a subsurface (52). FIGS. 6*a* to 6*e* show a schematic representation of a cross section of the engagement of the hook of the male connection element of a second plank (50) in the recess of the female connection element of a first plank (51), whereby the first plank (51) is positioned on a subsurface (52). FIG. 5*g* illustrates that the first plank (51) and the second plank (50) are loosely interlocked, allowing a modular floor built up of interlocked adjacent planks to conform to the contours of the supporting terrain, whether concaved or convexed.

As shown in FIG. 5*a*, placement of the recess (29) of the first plank (51) over the hook of the second plank (50) involves placement of the second recess portion (11) of the first plank (51) behind the second hook portion (4) of the second plank (50), thereby creating a loose hinge-type engagement between the second recess portion (11) of the first plank (51) and the second hook portion (4) of the second plank (50), around which the first plank (51) can be rotatively interlocked with the second plank (50), as shown in Figure sequence 5*a* to 5*g*, whereby the lower recess wall (12) of the first plank (51) is placed underneath the first hook portion (5) of the second plank (50) while maintaining said loose hinge-type engagement.

The applicant has found that when the slanted outer surface portion (15) does not extend sufficiently far over the width of the lower recess wall (12), the lower recess wall (12) of the first plank (51) substantially scrapes against and/or protrudes in the subsurface (52) on which the second plank (50) rests upon rotatively engaging the recess (29) of the first plank (51) over the hook of the second plank (50). The applicant has found that a slant size equal to at least 50% of the female connection element size in the width direction is sufficient to prevent said scraping against and/or protruding in the subsurface.

In a preferred embodiment, said slanted outer surface portion (15) of said lower recess wall (12) comprises an angle ($\alpha_1$) with respect to the width direction (x) of at least 5 degrees, preferably at least 7 degrees, such as 7 degrees, 8 degrees, 9 degrees, 10 degrees, 11 degrees, or any value above or in between. In addition to a slanted outer surface portion (15) which extends sufficiently far in the width direction (x), an increasing angle between the slanted outer surface portion (15) and the width direction (x) also helps in preventing said scraping against and/or protruding in the subsurface of said lower recess wall (12). In addition, said angle cannot become too large, as the lower recess wall should maintain sufficient strength near its lower recess wall end. The maximum angle depends on material characteristics, the thickness of the lower recess wall near the deflection line (17), and the desired strength near the lower recess wall end.

In a preferred embodiment, the upper recess wall of the female connection element (comprising the first recess portion (16), the corner recess portion (19), and the second recess portion (11)) extends outwardly in the width direction at least as far as the lower recess wall end of the female connection element. Preferably, the upper recess wall and the lower recess wall extend outwardly in the width direction in essence equally far, thereby comprising a common tangent plane parallel to the height direction. When the lower recess wall extends in the width direction beyond the upper recess wall, it is more likely to scrape against and/or protrude in the subsurface of the supporting terrain. Therefore, it is better to limit its extension in the width direction in the way disclosed above.

In a preferred embodiment, the male connection wall comprises an outer surface in essence parallel to the height direction (z), and the male connection element further comprises an upper filleted connection corner (6) and a lower filleted connection corner (7) at the attachment of the first hook portion (5) to the outer surface of the hook connection wall, whereby the hook connection wall comprises for each of said upper and lower filleted connection corners (6, 7) an adjacently faced inwardly extending thickening (8, 9). The thickenings hereby merge in a confluence portion (10) of the hook connection wall comprising a thickness less than each of the maximum thicknesses in the width direction of said thickenings of the hook connection wall.

The thickenings (8, 9) merged in the confluence portion (10) are particularly advantageous if the floor is laid onto an uneven terrain with concave and convex portion. On such a terrain, two connected planks or two connected components (such as a plank and a male/female ramp) may be oriented under an upward or a downward angle. Without wishing to be bound by theory, the applicants deem that torsion stress can thereby be induced around the upper filleted connection corner (6) and a lower filleted connection corner (7) as well as tension/pressure stresses oriented radially from said upper filleted connection corner (6) and said lower filleted connection corner (7). The thickenings (8, 9) in combination with the confluence portion (10) allow a better division of the induced torsion stresses around these connection corners and the tension/pressure stresses oriented radially from either of the connection corners when the connected planks are oriented under an angle due to any type of terrain (convex or concave or a combination of both).

The male and female connection elements are often subject to substantial stresses. The hook protrudes in the width direction away from the hook connection wall. The upper and lower recess walls protrude in the width direction away from the hind recess wall. These elements therefore often bump against other objects during transportation, for example, when a plank falls and hits the ground. Furthermore, when interlocked, they also experience substantial forces in use, for example, when a vehicle drives over a modular floor of interlocked planks. These elements should therefore comprise sufficient strength so as to not plie themselves, for example at the corner hook portion or the corner recess portion, nor at the connection with the remainder of the plank, for example, where the first hook portion is attached to the hook connection wall. These elements are therefore manufactured at least partially thicker than the plank plates. Specific dimensional details of a preferred embodiment are provided in the example below. The applicant has performed strength calculations, based on which he has noted that the hook connection wall can be made less thick at a height in between the heights of the upper and lower filleted corners without significantly loosing strength. It is therefore possible to save on both material and plank weight to obtain an in essence as strong connection of the hook to the remainder of the plank, leading to the design described above.

In a preferred embodiment, the top plate (1) and the bottom plate (2) comprise a plurality of ribs extending in the length direction and interspersed with channels (20, 21). A schematic representation of a cross section of a plank comprising top and bottom plates comprising ribs and channels is provided in FIG. 2. The channels are advantageous for several reasons. They allow, for example, for partial drainage of rain water and other fluids, which would otherwise remain on the top plate and cause the top plate to be slippery. In addition, the channels provide grip, both for persons and vehicles moving on the top plate and for the plank with respect to the subsurface. Protrusions of the subsurface, soles of shoes, and wheels of vehicles may at least partially enter a channel, thereby providing a hook-type grip in the channel and preventing unwanted movement perpendicular to the length direction.

In a preferred embodiment, each rib comprises an outer rib surface and each of the top and bottom plates comprises a channel bottom wall and two channel side walls. The channel bottom wall comprises a channel bottom surface (20) in essence parallel with the outer rib surfaces of the two adjacent ribs. Each of said two channel side walls comprises a channel side surface (21) extending from the channel bottom surface to the outer rib surface of one of said adjacent ribs. The channel bottom surface (20), the two side surfaces (21), and an open top face in essence coplanar with the outer rib surfaces of said two adjacent ribs delimit a channel. Preferably, each of the top and bottom plates comprises a plurality of channel bottom walls and corresponding pairs of channel side walls, defining a plurality of channels. The two channel side surfaces (21) of a channel thereby comprise an angle of at least 120 degrees with the channel bottom surface (20), such as an angle of 120 degrees, 125 degrees, 130 degrees, 135 degrees, 140 degrees, 145 degrees, 150 degrees, or any value in between. Most preferably, each of said two channel side surfaces (21) comprises an angle of in essence 135 degrees with the channel bottom surface (20). As a consequence, said two channel side surfaces are in essence mutually perpendicular. This is advantageous as skew channel side walls (21) with respect to the channel bottom surface (20), as described above, limit the amount of dirt which can be accumulated in the corners in between channel side walls and the channel bottom wall. Furthermore, it also allows for accumulated dirt to be more easily removed from the channels. A washing process for removing accumulated dirt may involve the collection of rain water in a basin comprising a driving ramp, driving one or more plates into the basin, washing the plates, and removing the one or more plates from the basin.

An outer rib surface comprises a rib width in the width direction. An open top face of a channel comprises a channel top width in the width direction. In a preferred embodiment, the channel top width is equal to at most 100% of said rib width, preferably at most 80% of said rib width, most preferably at most 60% of said rib width. The applicant has found that an enlarged rib width relative to the channel top width is beneficial to prevent slipping of persons wearing in essence flat-soled shoes, as the contact surface with the outer rib surfaces is enlarged, thereby providing a larger contact area where friction between a shoe sole and the outer rib surfaces is possible. Also for shoes comprising a highly corrugated sole profile, the combination of sole protrusions gripping in plank channels with the enlarged contacting surface between the sole and the outer rib surfaces leads to less chance for slipping.

In a preferred embodiment, each of the top and bottom plates comprises a plurality of channel bottom walls, whereby each spacing plate (3) of said plurality of spacing plates is connected (23) to a channel bottom wall of the top plate and a channel bottom wall of the bottom plate. Because a bottom wall is connected via skew channel side walls to the ribs and therefore the remainder of the top or bottom plate, shear and compression forces (in the width and/or height direction of the plank) are mediated to said remainder under two consecutive skew angles, thereby providing a more gradual transmission of said forces causing less stress on the interconnections between a spacing plate and the top and/or bottom plate.

In a preferred embodiment, the modular floor also comprises at least one male ramp, in addition to said planks. A schematic representation of a male ramp is provided in FIG. 4. A male ramp also comprises a length direction, a width direction, and a height direction which are mutually orthogonal, and an in essence uniform cross section perpendicular to the length direction, as it is preferably manufactured by extrusion, and preferably in the same material as said planks. The male ramp further comprises a bottom plate (31) extending in the width direction, a ramp plate (30) comprising a nonzero angle ($\alpha_2$) with the bottom plate (31), and a male connection element (4, 5, 8, 9, 18) connected to said bottom and ramp plates and configured for interlocking said male ramp with a plank of the modular floor via the female connection element of said plank. One of ordinary skill in the art will appreciate that specific features of preferred embodiments of the male connection element of a plank, such as, for example, the filleted connection corners (6, 7) and the corresponding thickenings (8, 9) which merge in a narrower confluence portion (10) of the hook connection wall, can also pertain to said male ramp. One of ordinary skill in the art will further also appreciate that specific features of preferred embodiments of the top and bottom plates of a plank, such as, for example, the ribs interspersed with channels (20, 21) can also pertain to said male ramp.

In a preferred embodiment, the modular floor also comprises at least one female ramp, in addition to said planks. A schematic representation of a female ramp is provided in FIG. 3. A female ramp also comprises a length direction, a width direction, and a height direction which are mutually orthogonal, and an in essence uniform cross section perpendicular to the length direction, as it is preferably manufactured by extrusion, and preferably in the same material as said planks. The female ramp further comprises a bottom plate (31) extending in the width direction, a ramp plate (30) comprising a nonzero angle ($\alpha_2$) with the bottom plate (31), and a female connection element (11, 12, 16, 19) connected to said bottom and ramp plates and configured for interlocking said female ramp with a plank of the modular floor via the male connection element of said plank. One of ordinary skill in the art will appreciate that specific features of preferred embodiments of the female connection element of a plank, such as, for example, the features related to the slanted outer surface portion (15) of the lower recess wall (12) can also pertain to said female ramp. One of ordinary skill in the art will further also appreciate that specific features of preferred embodiments of the top and bottom plates of a plank, such as, for example, the ribs interspersed with channels (20, 21) can also pertain to said female ramp.

The male and female ramps are advantageous as they facilitate access to a modular floor of interlocked planks, for example, for driving on and/or off the modular floor with a vehicle.

In a preferred embodiment, the male connection element of the plank, male ramp, modular floor and/or end floor piece comprises exactly one protrusion adapted for insertion into the recess (29) of the female connection element, said one protrusion comprising said hook (4, 5, 18). The one protrusion allows easier adaptation of the floor to both concave and convex underlying surfaces, because the angle between adjacent components, e.g. adjacent planks or adjacent plank and ramp, is not restricted by a second protrusion of the male connection element which needs to be inserted into the female connection element. This is thus a particularly interesting effect for floors which are laid onto an undulated or wavy terrain, whereby the floor is required to follow the outlay of the terrain, rather than to provide a completely planar surface across the full terrain such as is needed for landing mat installations.

In a preferred embodiment of the method for installing a modular floor for providing support to a vehicle and/or a crowd on an even, uneven or soft subsurface of a supporting terrain, the method comprises the steps of:

- providing at least three in essence identical planks, each plank comprising a male connection element comprising a hook and a female connection element comprising a recess, said hook and said recess configured for interlocking adjacent planks;
- positioning a first plank of said at least three planks on said subsurface;
- engaging the hook of the male connection element of a second plank of said at least three planks at least partially in the recess of the female connection element of said first plank positioned on said subsurface; and
- engaging the recess of the female connection element of a third plank of said at least three planks at least partially over the hook of the male connection element of said first plank positioned on said subsurface.

The method according to this preferred embodiment is advantageous as it allows to interlock a plank to an already positioned plank on a subsurface, with either one of the male and female connection element of said plank. In addition, a modular floor can be extended at both sides simultaneously, allowing for expeditious and flexible lay-out of the modular floor.

In a preferred embodiment of the method, said at least three planks comprise a fourth plank in essence identical to each of said at least three planks, and the method comprises at least one of the following steps:

engaging the hook of the male connection element of said second plank partially in the recess of the female connection element of said first plank and partially in the recess of the female connection element of said fourth plank; and engaging the recess of the female connection element of said third plank partially over the hook of the male connection element of said first plank and partially over the hook of the male connection element of said fourth plank.

Figure 7A:
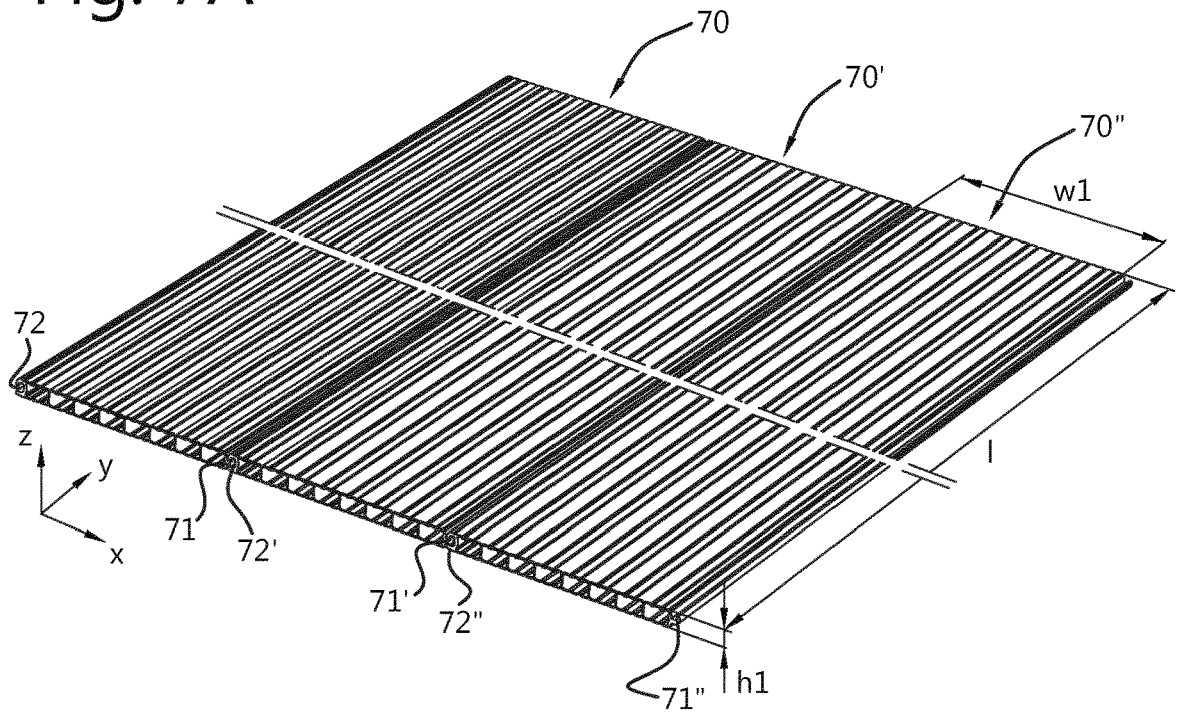
FIGS. 7*a* and 7*b* show a schematic perspective view of interlocked planks according to preferred embodiments of the present invention.
Figure 7B:
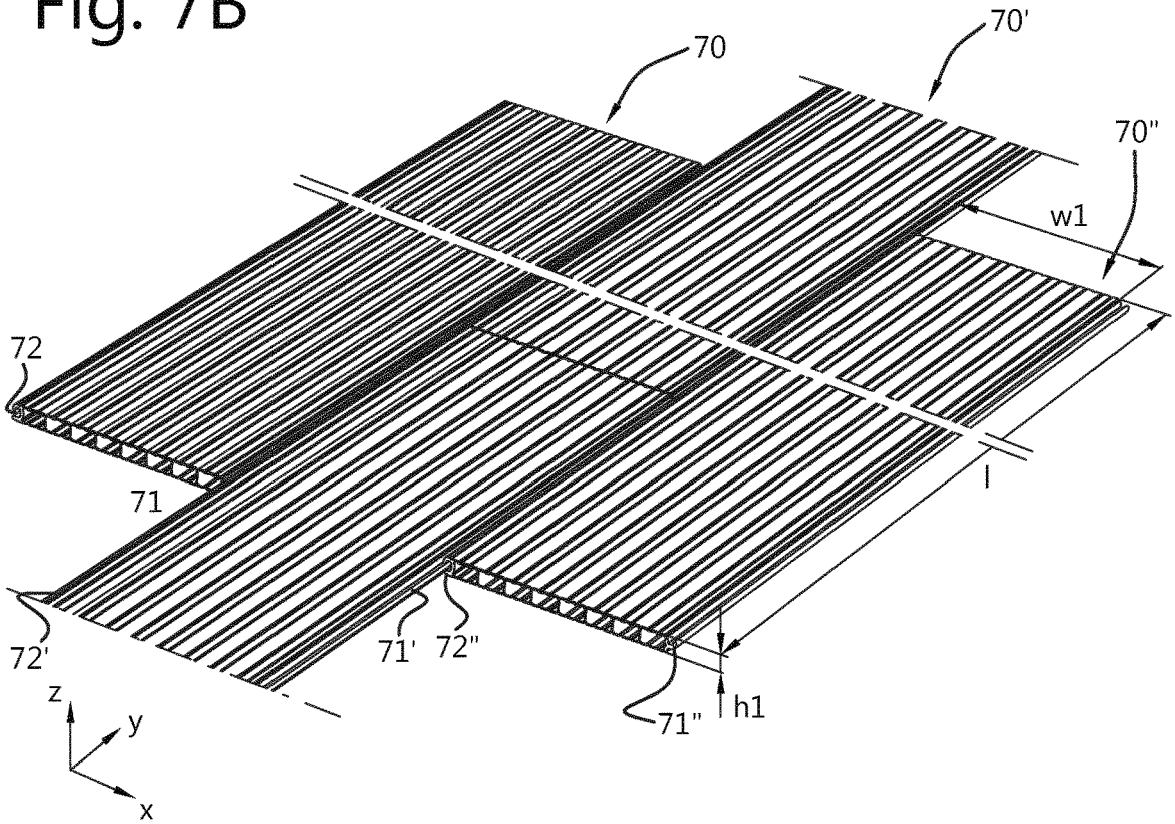

The modular floor can hence be laid out in a straight configuration, as illustrated in FIG. 7*a*, where a hook of a male connection element in essence completely interlocks in the recess of a female connection element, or alternatively in a staggered configuration, as illustrated in FIG. 7*b*, where a connection element of a plank can partially interlock with the dual connection element of each of two other planks. The staggered configuration is advantageous for modular floors extending substantially in essence in the length direction (y) of the interlocked planks as to provide more interlocking stability as well as to prevent substantial height changes in between neighboring planks in the length direction (y). To be able to lay out a modular floor in staggered configuration comprising a fixed dimension in essence in the length direction (y) of the interlocked planks, the modular floor can comprise a plurality of planks comprising a first length in the length direction and a plurality of planks comprising a second length in the length direction, whereby the second length is equal to in essence half of the first length.

Preferably, the modular floor of the present invention, comprises one or more planks having a length of between 2 m and 4 m, preferably between 2.5 m and 3.5 m, more preferably about 3 m. In view of the modular floor with a staggered pattern, the floor of the present invention preferably may comprise one or more planks having a length of between 1 m and 2 m, preferably between 1.25 and 1.75 m, more preferably about 1.5 m. In order to allow a different type of staggered pattern, or if the underlying terrain is very uneven on a scale of less than about 5 m, the modular floor preferably comprises one or more planks having a length of less than 1 m, preferably less than 0.9 m, more preferably about 0.75 m or smaller than 0.75 m. Planks having a small length allow better conformation of the modular floor in the length-direction in case of highly-curved terrains.

Figure 10:
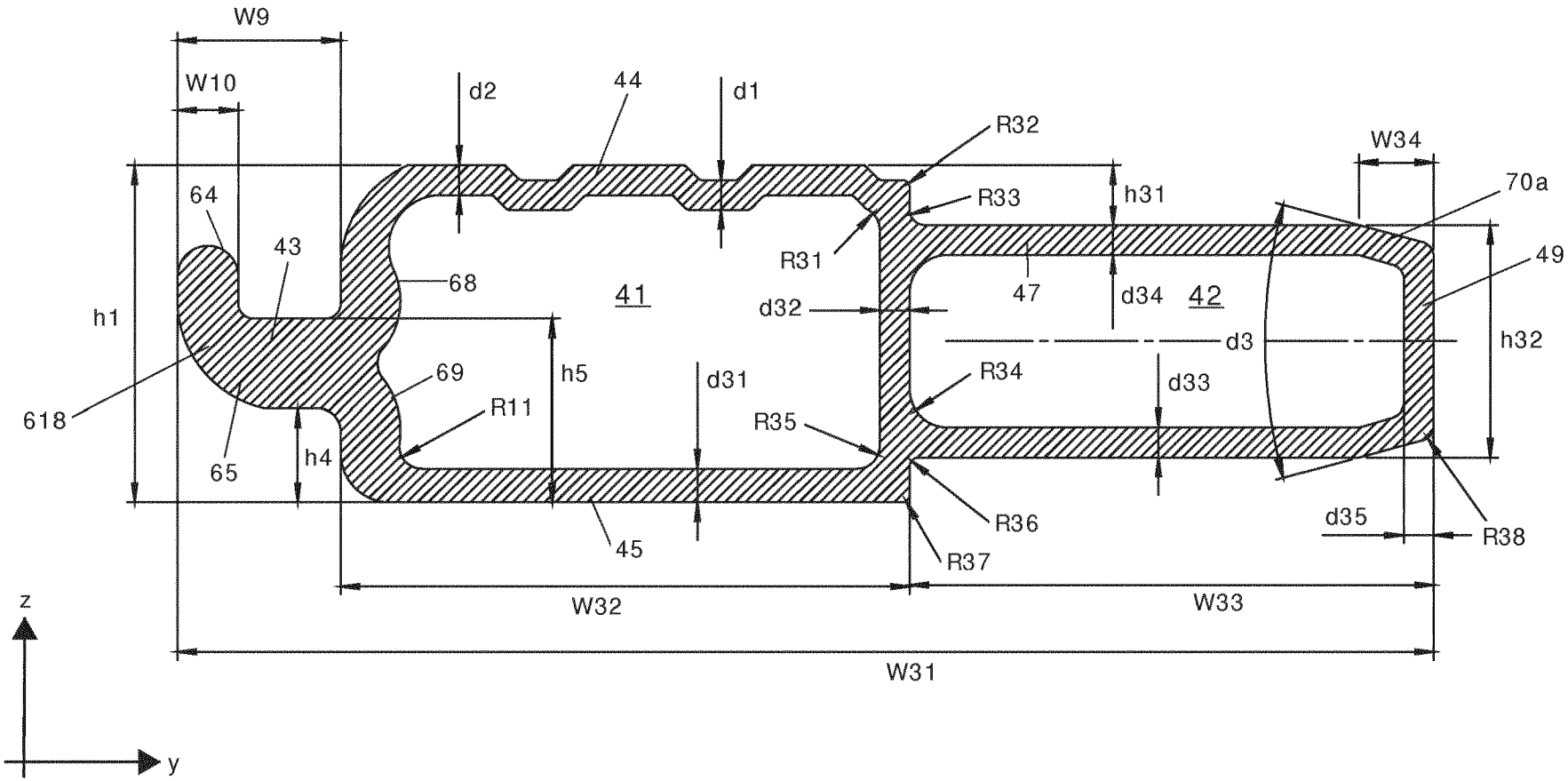
FIG. 10 shows a cross sectional view of an end floor piece according to the invention.
Figure 11:
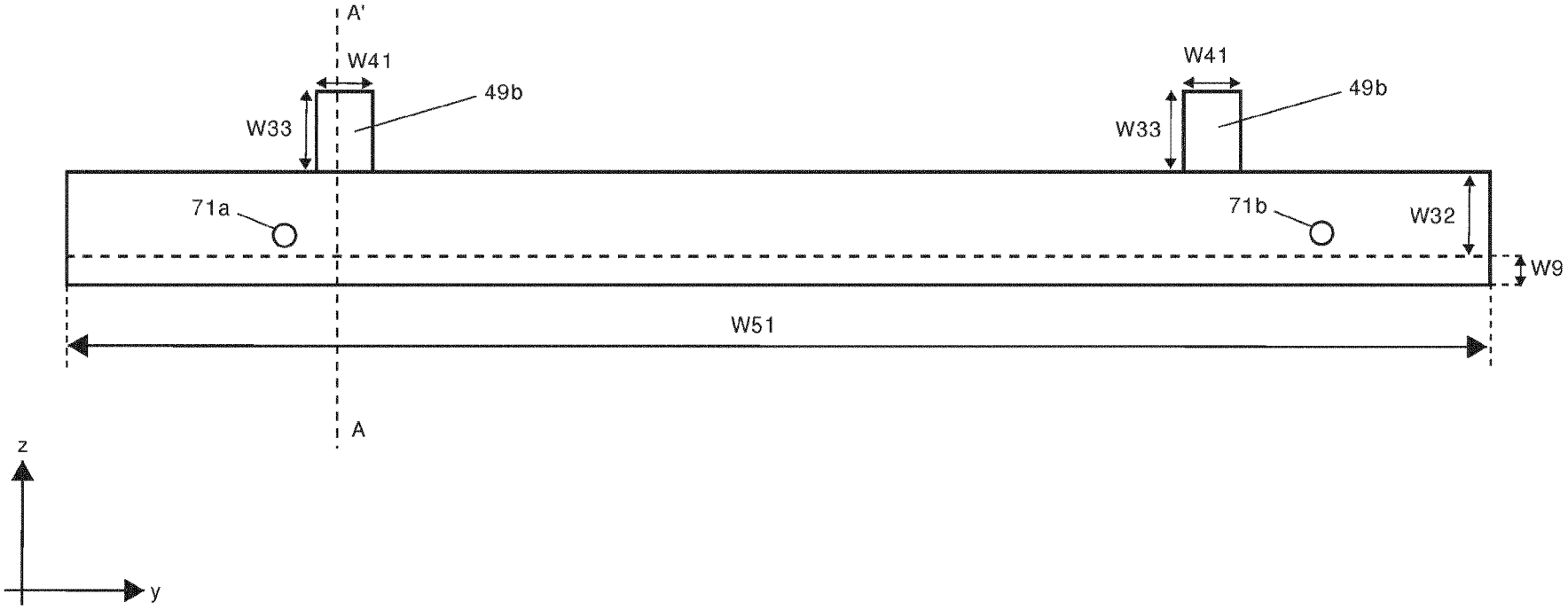
FIG. 11 illustrates a top view of such an end floor piece.

FIG. 10 shows a cross sectional view of an end floor piece according to the invention, which can be used to construct a modular floor according to the present invention. FIG. 11 illustrates a top view of such an end floor piece. FIG. 10 illustrates the cross sectional view along line AA' in FIG. 11.

The end floor piece is configured to be attached to the longitudinal ends of the planks of the invention. The longitudinal ends hereby refer to the extremal sides of the plank in the length direction (y).

The end floor piece comprises a central body portion (41), an insertion portion (42) and a connection element portion (43), which preferably comprises a male connection element with preferably the same cross section as the male connection element (4, 5, 8, 9, 18) of the plank as described above. References to width direction (x), length direction (y) and height direction (z) correspond to the directions referred to with respect to the modular floor or planks of the present invention.

The central body portion (41) comprises a top side and a bottom side spaced in the height direction (z), an in essence uniform cross section perpendicular to the width direction (x), a top plate (44) near the top side and a bottom plate (45) near the bottom side, the top and bottom plates (44, 45) extending in the length direction (y) and preferably comprising an open space in between. The central portion (41) also comprises a side wall (46) perpendicular to the length direction (y) and is connected to an insertion-side edge of the top plate (44) with the bottom plate (45).

The connection element portion (43) preferably comprises a male connection element (64, 65, 68, 69, 618) in accordance with the male connection element of the planks of the present invention (4, 5, 8, 9, 18), which is connected at a connection side-edge of the central body portion to the top and bottom plates (44, 45), the male connection element preferably comprising a hook connection wall (68, 69) extending from the bottom plate (45) to the top plate (44), the male connection element further comprising a hook (64, 65, 618) comprising a first hook portion (65) extending outwardly at least substantially in the length direction (y) from the hook connection wall (68, 69) to a corner hook portion (618) and a second hook portion (64) extending at least substantially in the height direction (z) from the corner hook portion (618) and towards the top side. Alternatively, the connection element portion may comprise a female connection element, preferably in accordance with the female connection element of the planks of the present invention, which is connected at a connection-side edge of the central body potion the top and bottom plates (44, 45). The female connection element hereby preferably comprises a recess formed by a lower recess wall extending outwardly at least substantially in the length direction (y) from the bottom plate (45) to a lower recess wall end, a hind recess wall extending from the bottom plate (45) to the top plate (44), and an upper recess wall comprising a first recess portion extending outwardly at least substantially in the length direction (y) from the top plate (44) to a corner recess portion and a second recess portion extending at least substantially in the height direction (z) from the corner recess portion and towards the lower recess wall, the recess of the female connection element and the hook of the male connection element configured for loosely interlocking with a corresponding connection element, allowing the modular floor to conform to the contours of said supporting terrain, whether concaved or convexed.

The insertion portion (42) comprises one or more, preferably at least two, insertion sections (49*a*,49*b*) with a top side and a bottom side spaced in the height direction (z) and comprising a top plate (47) and a bottom plate (48) attached to the side wall (46) of the central body portion (41) and extending therefrom in a length-wise insertion direction. The maximal height (h32) between top side of the top plate (47) and bottom side of the bottom plate (48) is smaller than the minimal height between top plate (1) and bottom plate (2) of a plank according to the present invention. The insertion sections are distributed along the side wall at positions which can be made to correspond to the positions of the open spaces formed by the longitudinal edges of the bottom plate, top plate and adjacent spacing plates of planks according to the present invention. Preferably, insertion sections may be positioned corresponding to the $1^{st}$, $2^{nd}$, $3^{rd}$, $4^{th}$, $5^{th}$, $6^{th}$, $7^{th}$, most preferably the $5^{th}$, open space of a plank of the invention, when counting from the edge comprising a male connection element and/or a female connection element.

The insertion sections of the insertion portion each comprise an extremal edge wall attached to the bottom (48) and top (47) plates at extremal edges in the length-wise insertion direction. Preferably the extremal edge wall (49) closes off the space between top (47) and bottom (48) plate in the insertion direction. Preferably the top plate (47) and/or the bottom plate (48) comprise a slanted extremal edge portion (70*a*, 70*b*) such that the height between top side of the top plate and the bottom side of the bottom plate diminishes at the extremal edge in the insertion direction.

Preferably the width of the end floor piece (w51), as measured in the width direction (x), corresponds to at least about the width (w1) of one plank according to the invention, more preferably to at least about twice the width (w1) of a plank according to the invention. Even more preferably, the width of the end floor piece (w51) is smaller than an integral times the width (w1) of one plank, i.e. w51=n*w1−delta, wherein n is an integer which is 1 or more, and delta is a size which is significantly smaller than the width (w1) of one plank, preferably 5% or less of the width of one plank, such as 4%, 3%, 2% of said width of one plank, or any value therebetween or below, most preferably about 1% of said with of one plank. For instance, the end floor piece may have a size in the width-direction 119.8 cm if the planks have a width of about 60 cm. The small, but preferably non-zero, delta may ensure that on very uneven terrains, adjacent end floor pieces do not hinder the ability of the modular floor to conform to highly uneven terrains.

Preferably the end floor piece is mounted in the modular floor to the longitudinal ends of the planks of the modular floor in a staggered pattern, wherein the ends of the end floor piece along the width direction are placed in a different position than the ends of the planks in the width-direction to which the end floor piece is attached. By placing the end floor piece, and preferably two or more end floor pieces, more preferably all end floor pieces, in a staggered pattern with respect to the planks, a stable beam-like configuration is obtained for the end floor pieces, which allows a more stable fastening of the end floor pieces and of the modular floor, in particular against movements in the length-direction.

Preferably the end floor piece comprises one or more, preferably at least two, holes (71*a*, 71*b*) for insertion along the height direction (z) of fasteners through the end floor piece, thereby allowing fixation of the end floor piece and thus of longitudinal ends of planks and a floor according to the invention.

Alternatively, or additionally, the end floor piece can be made less mobile, and preferably completely mobile, with respect to the underlying terrain, by mounting one or more planks or male ramps, preferably female ramps, to the connection element portion of the end floor piece. As the connection element portion preferably has the same form and dimensions as the connection element of the planks and ramp, the mounting of the planks or ramps to the end floor piece is straightforward.

An end floor piece can be manufactured by extrusion along the width direction (x), whereby preferably an intermediate insertion portion extending across the whole width (x) of the end flor piece is formed, and whereby subsequently parts of the intermediate insertion portion are removed to obtain a set of one or more insertion sections.

The modular floor according to the present invention preferably comprises at least one end floor piece according to the present invention.

The invention is further described by the following non-limiting example which further illustrates the invention, and is not intended to, nor should it be interpreted to, limit the scope of the invention.

Example

Figure 2:
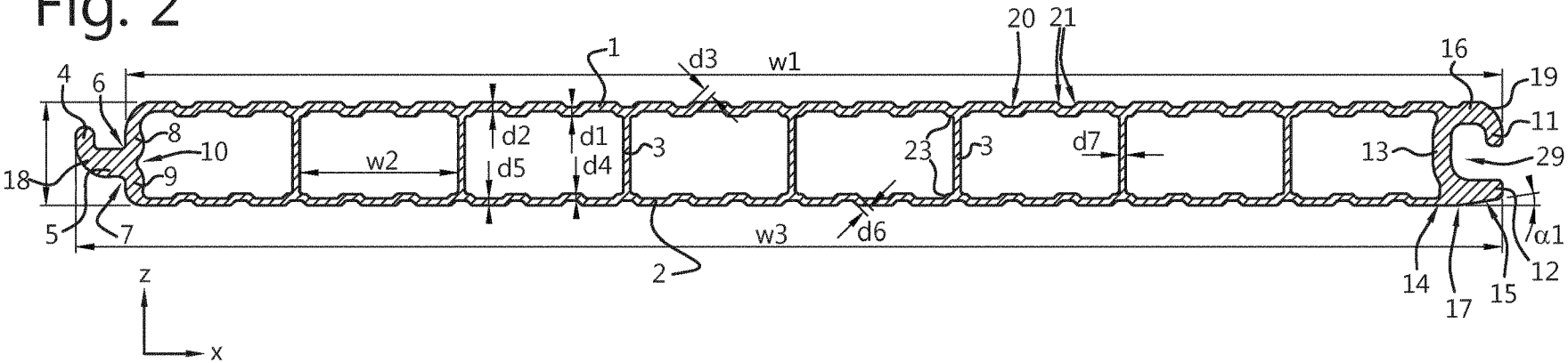
FIG. 2 shows a schematic representation of a cross section of a plank according to a preferred embodiment of the present invention.
Figure 3:
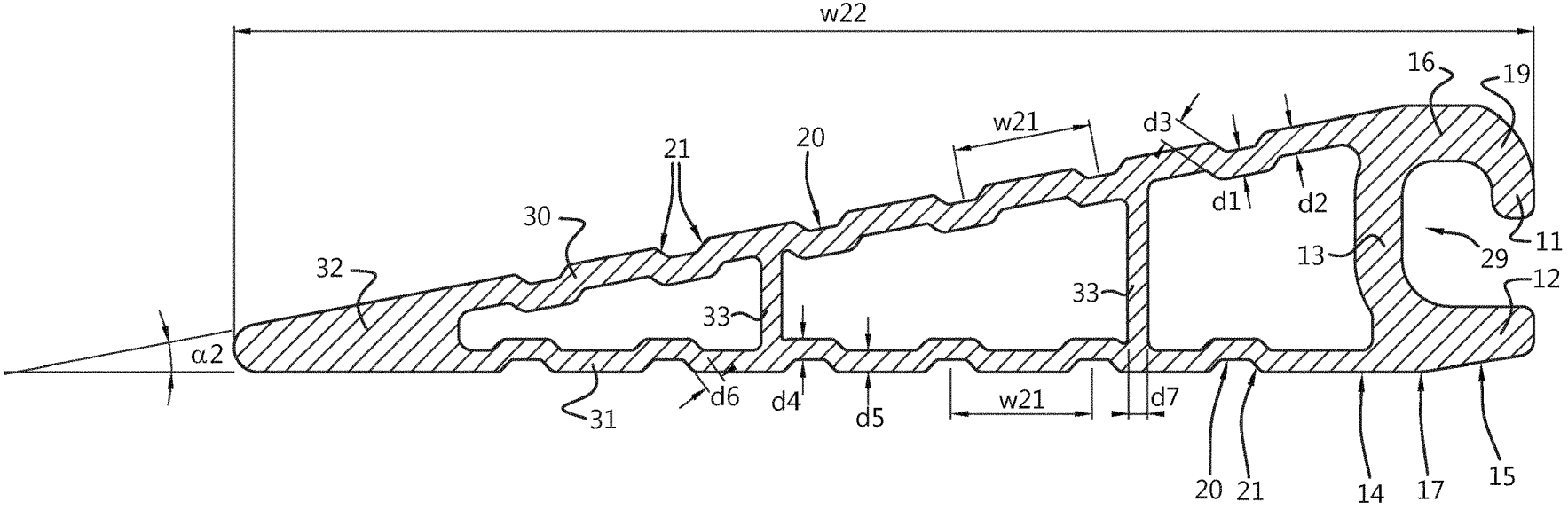
FIG. 3 shows a schematic representation of a cross section of a female ramp comprising a female connection element according to a preferred embodiment of the present invention.
Figure 4:
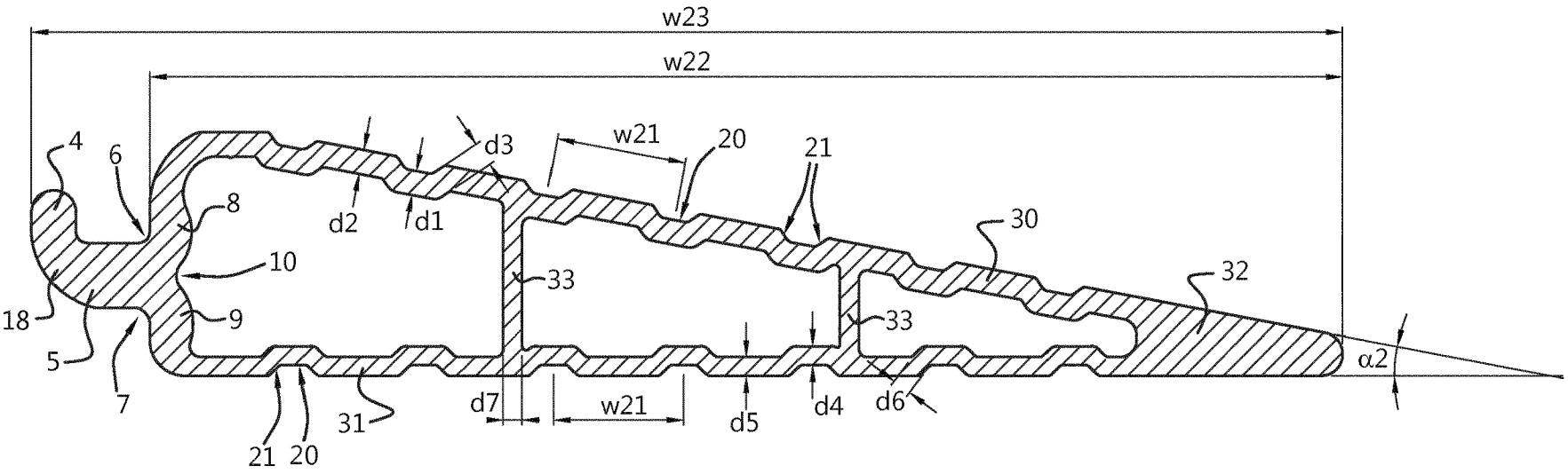
FIG. 4 shows a schematic representation of a cross section of a male ramp comprising a male connection element according to a preferred embodiment of the present invention.
Figure 6A:
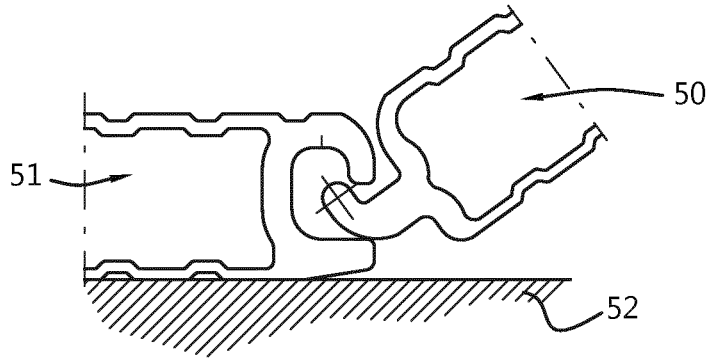
FIGS. 6*a* to 6*e* show a schematic representation of a cross section of the engagement of the hook of the male connection element of a second plank in the recess of the female connection element of a first plank according to a preferred embodiment of the present invention, whereby the first plank is positioned on a subsurface.
Figure 6B:
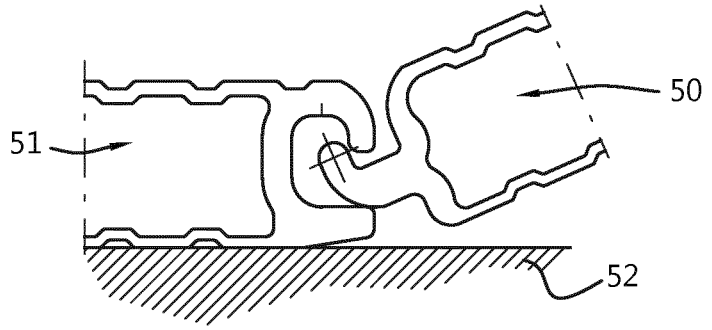
Figure 6C:
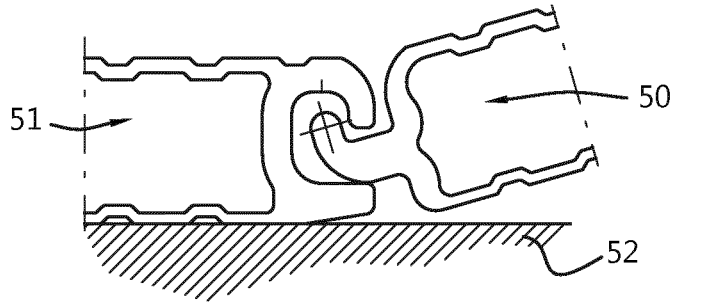
Figure 6D:
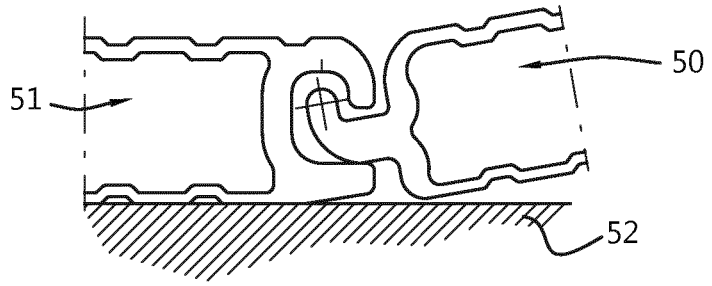
Figure 6E:
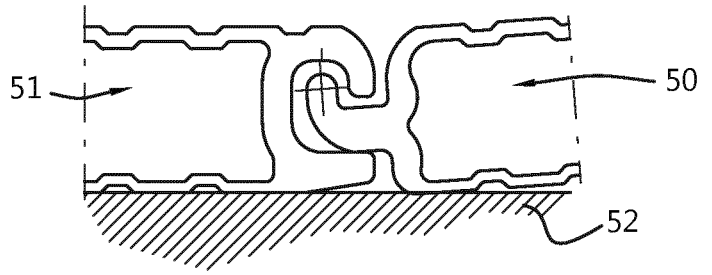

The example pertains to a modular floor comprising:

- a plurality of planks, each plank comprising an in essence uniform cross section perpendicular to the length or extrusion direction (y) of the plank as shown in FIG. 2;
- at least one female ramp, each female ramp comprising an in essence uniform cross section perpendicular to the length or extrusion direction (y) of the female ramp as shown in FIG. 3; and
- at least one male ramp, each male ramp comprising an in essence uniform cross section perpendicular to the length or extrusion direction (y) of the male ramp as shown in FIG. 4, and
- optionally at least one end floor piece as for instance shown in FIGS. 10 and 11.

The plurality of planks, the at least one female ramp, the at least one male ramp and the end floor piece are single-piece components, manufactured by extruding aluminum alloy 6005A which is heat-treated to the T-6 condition (aluminum alloy EN AW-6005A T6).

FIGS. 5*a* to 5*g* show a cross section of the engagement of the recess of the female connection element of a first plank (51) of the modular system of this example over the hook of the male connection element of a second plank (50) of the modular system of this example, whereby the second plank (50) is positioned on a subsurface (52).

FIGS. 6*a* to 6*e* show a cross section of the engagement of the hook of the male connection element of a second plank (50) of the modular system of this example in the recess of the female connection element of a first plank (51) of the modular system of this example, whereby the first plank (51) is positioned on a subsurface.

The planks of the modular floor of this example can be interlocked in regular configuration (FIG. 7*a*) or in staggered configuration (FIG. 7*b*).

Figure 8:
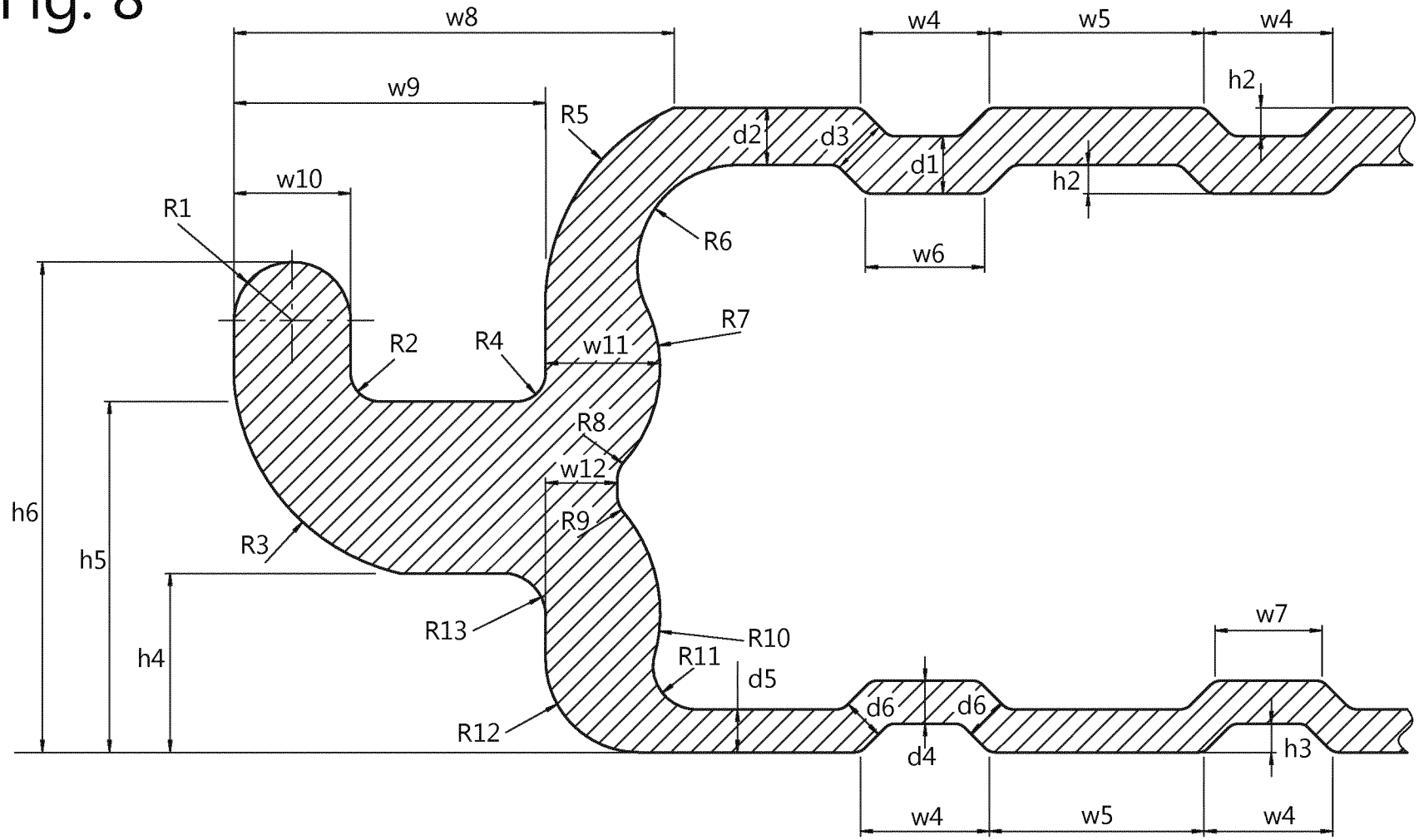
FIG. 8 shows a schematic representation comprising a detailed cross section of a male connection element according to a preferred embodiment of the present invention.
Figure 9:
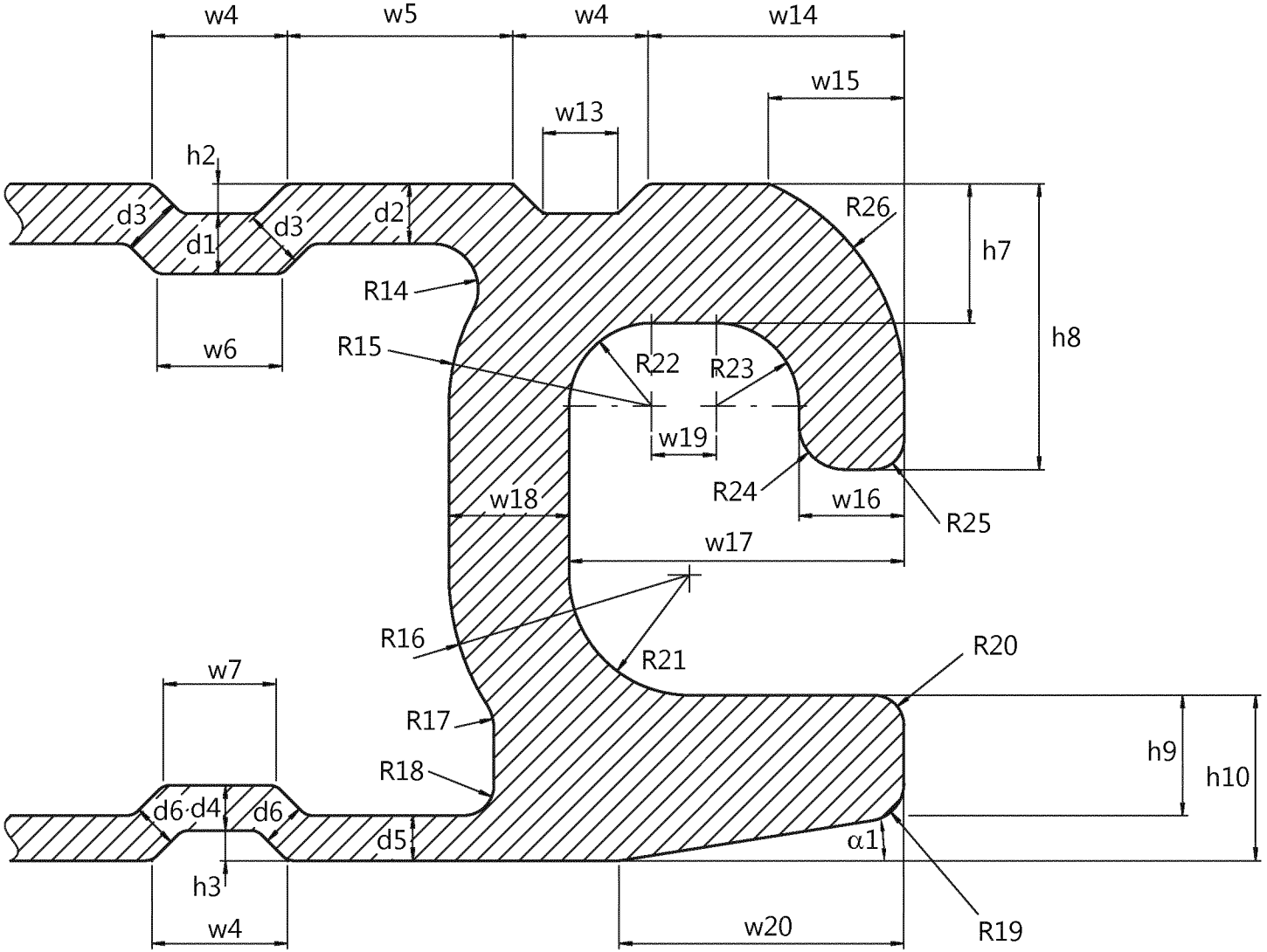
FIG. 9 shows a schematic representation comprising a detailed cross section of a female connection element according to a preferred embodiment of the present invention.

FIGS. 8 and 9 show a detailed cross section of the male connection element and the female connection element, respectively, of a plank of the modular system of this example.

One of ordinary skill will therefore appreciate that any features disclosed in the detailed description of this document in relation to, and shown in, FIGS. 2 to 9 pertain to this example as well. In what follows, dimensional details related to the different components of the modular floor will be provided.

A plank comprises a length (l) of about 3000 mm in the length or extrusion direction (y), a total width (w3) of about 621.8 mm in the width direction (x), and a total height (h1) of about 45 mm in the height direction (z). The total height (h1) can also be smaller or larger. In certain embodiments, the plank may comprise a total height (h1) of 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, or any value above or in between. The plank is typically better able to withstand bending stresses as the total height (h1) increases. In the embodiment disclosed in this example, the total height (h1) is 45 mm. The total width (w3) consists of the plank connection width (w1) of about 600 mm in between and including the hook connection wall and the female connection element and the protrusion length (w9) of about 21.8 mm of the hook in the width direction. The distance (w2) in between two neighboring and in essence parallel spacing plates is about 69 mm. The thickness of the top plate ribs (d2), top plate channel bottom walls (d1), and top plate channel side walls (d3) is about 4 mm. The thickness of the bottom plate ribs (d5), bottom plate channel bottom walls (d4), and bottom plate channel side walls (d6) is about 3 mm. The thickness of the spacing plates is about 3 mm. The top plate therefore comprises a thickness which is larger than the thicknesses of the spacing plates and the bottom plate. The channels comprise a depth (h2, h3) in the height direction (z) of about 2 mm. The channel top width (w4) is about 9 mm and the rib width (w5) is about 15 mm. Therefore, the channel top width is equal to about 60% of the channel top width. The channel side walls comprise an angle with the corresponding channel bottom wall of about 135 degrees. Therefore, the channel bottom surface comprises a channel bottom width (w13) of about 5 mm. Due to the different thicknesses of the top and bottom plates, the inwardly directed face of the channel bottom wall at the top plate comprises a width (w6) of about 8.3 mm, which is larger than the width (w7) of about 7.5 mm of the inwardly directed face of the channel bottom wall at the bottom plate. The female connection element comprises a wall thickness at the lower recess wall (h9), the hind recess wall (w18) and the upper recess wall (w6, h7) of at least about 7 mm. The thickenings of the hook connection wall comprise a width (w11) of about 8 mm, which is significantly more than the width (w12) of about 5 mm of the confluence portion of the hook connection wall. The first hook portion comprises a width in the height direction of about 12 mm. The female connection element comprises a female connection element size in the width direction (w17+w18) of about 30.3 mm. The slanted size in the width direction (w20) is about 18.94 mm. Therefore, the slanted size is equal to about 62.51% of the female connection element size. The slanted outer surface portion comprises an angle ($\alpha_1$) with respect to the width direction of 9 degrees. The plank comprises eight box-like sections formed by the seven spacing plates.

The female and male ramps comprise a ramp connection width (w22) of about 220 mm. The total width of a male ramp (w23) is about 241.8 mm due to the protrusion length (w9) of the hook of about 21.8 mm. The ramp plate (30) and the bottom plate (31) comprise an angle in between ($\alpha_2$) of about 10.78 degrees. The ramp plate (30) comprises a thickness (d1, d2, d3) of about 4 mm, while the bottom plate (31) and the spacing plates comprise a thickness (d4, d5, d6, d7) of about 3 mm.

Further dimensional aspects related to the plank and the ramps can be retrieved in Table 1. Parameters starting with an R in Table 1 relate to the radius of curvature of the corresponding element. Parameters starting with the letter d, h, or w correspond to linear sizes. One of ordinary skill will appreciate that a parameter in the first column of Table 1 comprises a value of about the corresponding size in the second column of Table 1.

TABLE 1

| Parameters as shown in FIGS. 2 to 9. | |
|---|---|
| Parameter | Size (in millimeter) |
| h1 | 45 |
| h2 | 2 |

TABLE 1-continued

| Parameters as shown in FIGS. 2 to 9. | |
|---|---|
| Parameter | Size (in millimeter) |
| h3 | 2 |
| h4 | 12.5 |
| h5 | 24.5 |
| h6 | 34.2 |
| h7 | 9.3 |
| h8 | 19 |
| h9 | 8 |
| h10 | 11 |
| d1 | 4 |
| d2 | 4 |
| d3 | 4 |
| d4 | 3 |
| d5 | 3 |
| d6 | 3 |
| d7 | 3 |
| w1 | 600 |
| w2 | 69 |
| w3 | 621.8 |
| w4 | 9 |
| w5 | 15 |
| w6 | 8.3 |
| w7 | 7.5 |
| w8 | 30.8 |
| w9 | 21.8 |
| w10 | 8.2 |
| w11 | 8 |
| w12 | 5 |
| w13 | 5 |
| w14 | 17 |
| w15 | 9 |
| w16 | 7 |
| w17 | 22.3 |
| w18 | 8 |
| w19 | 4.3 |
| w20 | 18.94 |
| w21 | 24 |
| w22 | 220 |
| w23 | 241.8 |
| R1 | 4.1 |
| R2 | 2 |
| R3 | 15 |
| R4 | 2 |
| R5 | 15 |
| R6 | 7 |
| R7 | 9.8 |
| R8 | 2 |
| R9 | 2 |
| R10 | 11 |
| R11 | 3 |
| R12 | 6.5 |
| R13 | 3 |
| R14 | 3 |
| R15 | 13.5 |
| R16 | 16 |
| R17 | 17 |
| R18 | 2 |
| R19 | 2.5 |
| R20 | 2 |
| R21 | 8 |
| R22 | 5.5 |
| R23 | 5.5 |
| R24 | 3 |
| R25 | 2 |
| R26 | 15 |

FIG. 10 shows a cross sectional view of an end floor piece according to the invention, which can be used to construct a modular floor according to the present invention. FIG. 11 illustrates a top view of such an end floor piece.

The end floor piece is configured to be attached to the longitudinal ends of the planks of the invention. The longitudinal ends hereby refer to the extremal sides of the plank in the length direction (y).

Dimensional aspects related to the end floor piece can be retrieved in Table 2. Parameters starting with an R in Table 2 relate to the radius of curvature of the corresponding element. Parameters starting with the letter d, h, or w correspond to linear sizes. One of ordinary skill will appreciate that a parameter in the first column of Table 2 comprises a value of about the corresponding size in the second column of Table 2. The angle $\alpha_3$ in FIG. 10 can be about 30°.

TABLE 2

Parameters as shown in FIGS. 10 and 11.

| Parameter | Size (in millimeter) |
|---|---|
| h1 | 45 |
| h4 | 12.5 |
| h5 | 24.5 |
| h31 | 8 |
| h32 | 31 |
| d1 | 4 |
| d2 | 4 |
| d31 | 4.5 |
| d32 | 4 |
| d33 | 4 |
| d34 | 4 |
| d35 | 4 |
| w9 | 21.8 |
| w10 | 8.2 |
| w31 | 167.78 |
| w32 | 76 |
| w33 | 70 |
| w34 | 10 |
| w41 | 50 to 69 |
| w51 | 1198 |
| R11 | 3 |
| R31 | 3 |
| R32 | 1 |
| R33 | 2 |
| R34 | 5 |
| R35 | 3 |
| R36 | 1.2 |
| R37 | 1 |
| R38 | 2 |

The invention claimed is:

1. A modular floor for providing support to a vehicle and/or a crowd on an uneven or soft subsurface of a supporting terrain, comprising at least two planks, each plank comprising a length direction, a width direction, and a height direction which are mutually orthogonal, a top side and a bottom side spaced in the height direction, an in essence uniform cross section perpendicular to the length direction, a top plate near the top side and a bottom plate near the bottom side, the top and bottom plates extending in the width direction and mutually separated by a plurality of spacing plates in essence parallel to the height direction, a first plank of the at least two planks comprising a male connection element connected at an edge of the first plank to the top and bottom plates, the male connection element comprising a hook connection wall extending from the bottom plate to the top plate, the male connection element further comprising a hook comprising a first hook portion extending outwardly at least substantially in the width direction from the hook connection wall to a corner hook portion and a second hook portion extending at least substantially in the height direction from the corner hook portion and towards the top side, a second plank of the at least two planks comprising a female connection element connected at an edge of the second plank to the top and bottom plates, the female connection element comprising a recess formed by a lower recess wall extending outwardly at least substantially in the width direction from the bottom plate to a lower recess wall end, a hind recess wall extending from the bottom plate to the top plate, and an upper recess wall comprising a first recess portion extending outwardly at least substantially in the width direction from the top plate to a corner recess portion and a second recess portion extending at least substantially in the height direction from the corner recess portion and towards the lower recess wall, the recess of the female connection element and the hook of the male connection element configured for loosely interlocking the first and the second plank allowing the modular floor to conform to the contours of said supporting terrain, whether concaved or convexed, wherein said hook connection wall comprises an outer surface in essence parallel to the height direction, said male connection element comprising an upper and a lower filleted connection corner at the attachment of said hook to said outer surface of said hook connection wall, whereby said hook connection wall comprises for each of said upper and lower filleted connection corners an adjacently faced inwardly extending thickening, whereby said thickenings merge in a confluence portion of the hook connection wall comprising a thickness less than each of the maximum thicknesses of said thickenings of the hook connection wall.

2. Modular floor according to claim 1, wherein said at least two planks are identical, wherein each plank comprises a male connection element and a female connection element separated in the width direction by the top and bottom plates and connected to the top and bottom plates.

3. Modular floor according to claim 1, wherein the lower recess wall comprises an outer surface comprising a slanted portion extending from a deflection line towards said lower recess wall end and at least partially in the height direction towards said top side, whereby said slanted portion comprises a slant size in the width direction equal to at least 50% of the female connection element size in the width direction.

4. Modular floor according to claim 3, wherein said slanted outer surface portion of said lower recess wall comprises an angle with respect to the width direction of at least 5 degrees.

5. Modular floor according to claim 1, wherein said upper recess wall of said female connection element extends outwardly in the width direction at least as far as said lower recess wall end of said female connection element.

6. Modular floor according to claim 1, wherein the top and the bottom plate comprise a plurality of ribs extending in the length direction and interspersed with channels.

7. Modular floor according to claim 6, each rib comprising an outer rib surface, the top and the bottom plate each comprising a channel bottom wall and two channel side walls, said channel bottom wall comprising a channel bottom surface in essence parallel with the outer rib surfaces of the two adjacent ribs, each of said two channel side walls comprising a channel side surface extending from said channel bottom surface to the outer rib surface of one of said adjacent ribs, whereby said channel bottom surface, said two channel side surfaces, and an open top face in essence coplanar with said outer rib surfaces of said two adjacent ribs delimit a channel, wherein each of said two channel side surfaces comprises an angle of at least 120 degrees with the channel bottom surface.

8. Modular floor according to claim 7, an outer rib surface comprising a rib width in the width direction, said open top face comprising a channel top width in the width direction, wherein said channel top width is equal to at most 80% of said rib width.

9. Modular floor according to claim 1, wherein each plank is a single-piece component.

10. Modular floor according to claim 1, wherein the modular floor further comprises at least one male ramp, a male ramp comprising a length direction, a width direction, and a height direction which are mutually orthogonal, the male ramp further comprising an in essence uniform cross section perpendicular to the length direction, a bottom plate extending in the width direction, a ramp plate comprising a nonzero angle with the bottom plate, and a male connection element connected to said bottom and ramp plates and configured for interlocking said male ramp with the second plank of the modular floor comprising said female connection element.

11. Modular floor according to claim 1, wherein the modular floor further comprises at least one female ramp, a female ramp comprising a length direction, a width direction, and a height direction which are mutually orthogonal, the female ramp further comprising an in essence uniform cross section perpendicular to the length direction, a bottom plate extending in the width direction, a ramp plate comprising a nonzero angle with the bottom plate, and a female connection element connected to said bottom and ramp plates and configured for interlocking said female ramp with the first plank of the modular floor comprising said male connection element.

12. Modular floor according to claim 1, wherein the male connection element comprises exactly one protrusion adapted for insertion into the recess of the female connection element, said one protrusion comprising said hook.

13. Modular floor according to claim 1, wherein the plank comprises a length in the length direction of about 3000 mm, wherein the plank comprises a plank connection width in the width direction of about 600 mm, wherein the plank comprises a total height in the height direction of about 35 mm, wherein about encompasses variations of +/−20% or less.

14. Plank for providing support to a vehicle and/or a crowd on an uneven or soft subsurface of a supporting terrain, the plank comprising a length direction, a width direction, and a height direction which are mutually orthogonal, a top side and a bottom side spaced in the height direction, the plank further comprising an in essence uniform cross section perpendicular to the length direction, a top plate near the top side and a bottom plate near the bottom side, the top and bottom plates extending in the width direction and mutually separated by a plurality of spacing plates in essence parallel to the height direction, the plank further comprising a male connection element and a female connection element separated in the width direction by the top and bottom plates and connected to the top and bottom plates, the male connection element comprising a hook connection wall extending from the bottom plate to the top plate, the male connection element further comprising a hook comprising a first hook portion extending outwardly at least substantially in the width direction from the hook connection wall to a corner hook portion and a second hook portion extending at least substantially in the height direction from the corner hook portion and towards the top side, the female connection element comprising a recess formed by a lower recess wall extending outwardly at least substantially in the width direction from the bottom plate to a lower recess wall end, a hind recess wall extending from the bottom plate to the top plate, and an upper recess wall comprising a first recess portion extending outwardly at least substantially in the width direction from the top plate to a corner recess portion and a second recess portion extending at least substantially in the height direction from the corner recess portion and towards the lower recess wall, the recess of the female connection element and the hook of the male connection element configured for loosely interlocking adjacent in essence identical planks for forming a modular floor which is enabled to conform to the contours of said supporting terrain, whether concaved or convexed, wherein said hook connection wall comprises an outer surface in essence parallel to the height direction, said male connection element comprising an upper and a lower filleted connection corner at the attachment of said hook to said outer surface of said hook connection wall, whereby said hook connection wall comprises for each of said upper and lower filleted connection corners an adjacently faced inwardly extending thickening, whereby said thickenings merge in a confluence portion of the hook connection wall comprising a thickness less than each of the maximum thicknesses of said thickenings of the hook connection wall.

15. Method for installing a modular floor for providing support to a vehicle and/or a crowd on an even, uneven or soft subsurface of a supporting terrain, comprising the steps of:

providing at least three in essence identical planks according to claim 14, each plank comprising a male connection element comprising a hook and a female connection element comprising a recess, said hook and said recess configured for interlocking adjacent planks;

positioning a first plank of said at least three planks on said subsurface;

engaging the hook of the male connection element of a second plank of said at least three planks at least partially in the recess of the female connection element of said first plank positioned on said subsurface; and engaging the recess of the female connection element of a third plank of said at least three planks at least partially over the hook of the male connection element of said first plank positioned on said subsurface.

16. Method according to claim 15, whereby said at least three planks comprise a fourth plank in essence identical to each of said at least three planks, the method comprising at least one of the following steps:

engaging the hook of the male connection element of said second plank partially in the recess of the female connection element of said first plank and partially in the recess of the female connection element of said fourth plank; and engaging the recess of the female connection element of said third plank partially over the hook of the male connection element of said first plank and partially over the hook of the male connection element of said fourth plank.

* * * * *